United States Patent [19]

Kriegner

[11] Patent Number: 4,509,582

[45] Date of Patent: Apr. 9, 1985

[54] METHOD OF AND ARRANGEMENT FOR, RECOVERING THE SENSIBLE HEAT OF A CONTINUOUSLY CAST STRAND

[75] Inventor: Othmar Kriegner, St. Valentin, Austria

[73] Assignee: Voest-Alpine Aktiengesellschaft, Linz, Austria

[21] Appl. No.: 546,066

[22] Filed: Oct. 27, 1983

Related U.S. Application Data

[63] Continuation of Ser. No. 248,979, Mar. 30, 1981, abandoned.

[30] Foreign Application Priority Data

Apr. 15, 1980 [AT] Austria ..... 2024/80

[51] Int. Cl.[3] ..... B22D 11/124; F27D 15/02

[52] U.S. Cl. ..... 164/486; 134/107; 134/108; 164/5; 164/444; 165/47; 165/102; 432/77

[58] Field of Search ..... 164/486, 459, 76.1, 164/417, 5, 444; 134/65 R, 122 R, 105, 107, 108; 432/77; 165/47, 102

[56] References Cited

U.S. PATENT DOCUMENTS

| | | | |
|---|---|---|---|
| 3,957,111 | 5/1976 | Kobayashi et al. . | |
| 4,050,884 | 9/1977 | Jablin | 432/90 X |
| 4,351,633 | 9/1982 | Ortner et al. | 432/77 |

FOREIGN PATENT DOCUMENTS

| | | | |
|---|---|---|---|
| 2117621 | 3/1973 | Fed. Rep. of Germany . | |
| 2622722 | 12/1976 | Fed. Rep. of Germany . | |
| 333805 | 12/1958 | Switzerland . | |
| 942248 | 11/1963 | United Kingdom . | |
| 1505390 | 12/1976 | United Kingdom . | |
| 0673823 | 7/1979 | U.S.S.R. | 432/77 |

*Primary Examiner*—Nicholas P. Godici
*Assistant Examiner*—J. Reed Batten, Jr.
*Attorney, Agent, or Firm*—Brumbaugh, Graves, Donohue & Raymond

[57] ABSTRACT

A continuously cast strand is guided through a cooling chamber and brought into direct contact with a coolant evaporating partially. The coolant vapor is brought into heat exchange with a closed surface condenser arranged within the cooling chamber, and a flow-through medium of the surface condenser is brought into further heat exchange with a heat transformer arranged outside the cooling chamber and connected with the condenser.

13 Claims, 3 Drawing Figures

METHOD OF AND ARRANGEMENT FOR, RECOVERING THE SENSIBLE HEAT OF A CONTINUOUSLY CAST STRAND

This application is a continuation of application Ser. No. 248,979, filed on Mar. 30, 1981 and now abandoned.

BACKGROUND OF THE INVENTION

The invention relates to a method of recovering the sensible heat of a cast strand cast by the continuous casting method, which cast strand is guided through a cooling chamber and brought into direct contact with a coolant, which evaporates partially.

The coolant vapor forming within a cooling chamber known, for example, from German Pat. No. 2,117,621 has been conducted away from the continuous casting plant and the hall surrounding this plant through a stack by means of a ventilator. Although the continuous casting plant is kept free of vapor, extensive mechanical measures are required for sucking off the vapor, which results also in a high consumption of energy. In addition, conducting away the vapor into the open air has a negative effect on the environment. Further, the vapor released to the open air is lost as a coolant, so that the coolant supplied to the cooling chamber must be complemented continuously.

To prevent the envelopment of a continuous casting plant in a cloud of vapor, it is known from Swiss Pat. No. 333,805 to provide a covering at the post-cooling path, on which the vapor condensed precipitates and flows off. Additionally, the vapor, according to Swiss Pat. No. 333,805, also may be sucked off and supplied to a condenser. This known vapor precipitation is not sufficient for modern continuous casting plants, in particular continuous casting plants for slabs, which have high casting speeds, because vapor would enter the hall owing to the large amounts of heat being transformed, enveloping the plant in a cloud of vapor despite the covering. As noted with respect to the above German patent, the sucking-off of the vapor here again requires complex mechanical means and a steady energy consumption.

SUMMARY OF THE INVENTION

The invention aims at avoiding these disadvantages and difficulties' and has as its object to provide a method, as well as an arrangement for carrying out the method, of recovering and utilizing at least part of the sensible heat of the cast strand, the need for sucking-off the coolant vapor being obviated, while at the same time preventing the escape of coolant vapor into the hall.

This object is achieved according to the invention in that the coolant vapor is set into heat exchange with a closed surface condenser arranged within the cooling chamber, and a flow-through medium of the surface condenser is set into further heat exchange with a heat transformer arranged outside the cooling chamber.

To use the same treated flow-through medium repeatedly, it is advantageously guided in a closed circuit independently of the coolant.

Preferably, the coolant also is guided in a closed circuit, the condensate being used partly for newly cooling the strand surface and partly as a flow-through medium for the surface condenser. The flow-through medium leaving the heat transformer also is used partly for cooling the strand surface and partly as a flow-through medium for the condenser.

An arrangement for carrying out the method of the invention in a continuous casting plant, in particular in a continuous casting plant for slabs, comprises a closed cooling chamber in which the secondary cooling zone for the cast strand is provided with spraying nozzles for the coolant directed toward the cast strand. Within the cooling chamber, at least one closed surface condenser through which a flow-through medium flows is provided, which is connected with at least one heat transformer arranged outside the cooling chamber.

Preferably, the surface condenser is connected with the heat transformer so as to form a closed circuit.

In order to reach a temperature as high as possible for the flow-through medium, a plurality of surface condensers are connected in series within the cooling chamber.

If the flow-through medium is to be maintained at a low temperature, a plurality of surface condensers are connected in parallel within the cooling chamber.

According to a preferred embodiment, the surface condensers are arranged on the ceiling of the cooling chamber. The side walls of the cooling chamber are covered with an insulating or sealing foil. One surface condenser is designed as a plate through which the flow-through medium flows, covering the cooling chamber and provided with deflection rods in its interior, and a further surface condenser is designed as a tube coil situated immediately below the plate.

It is a further advantage if the surface condensers are arranged with the heat transformer parallel to the coolant flow in the secondary cooling zone within the cooling chamber.

BRIEF DESCRIPTION OF THE DRAWINGS

The invention will now be explained in more detail by way of two embodiments schematically illustrated in the accompanying drawings, wherein.

DESCRIPTION OF EXEMPLARY EMBODIMENTS

Figure 1:
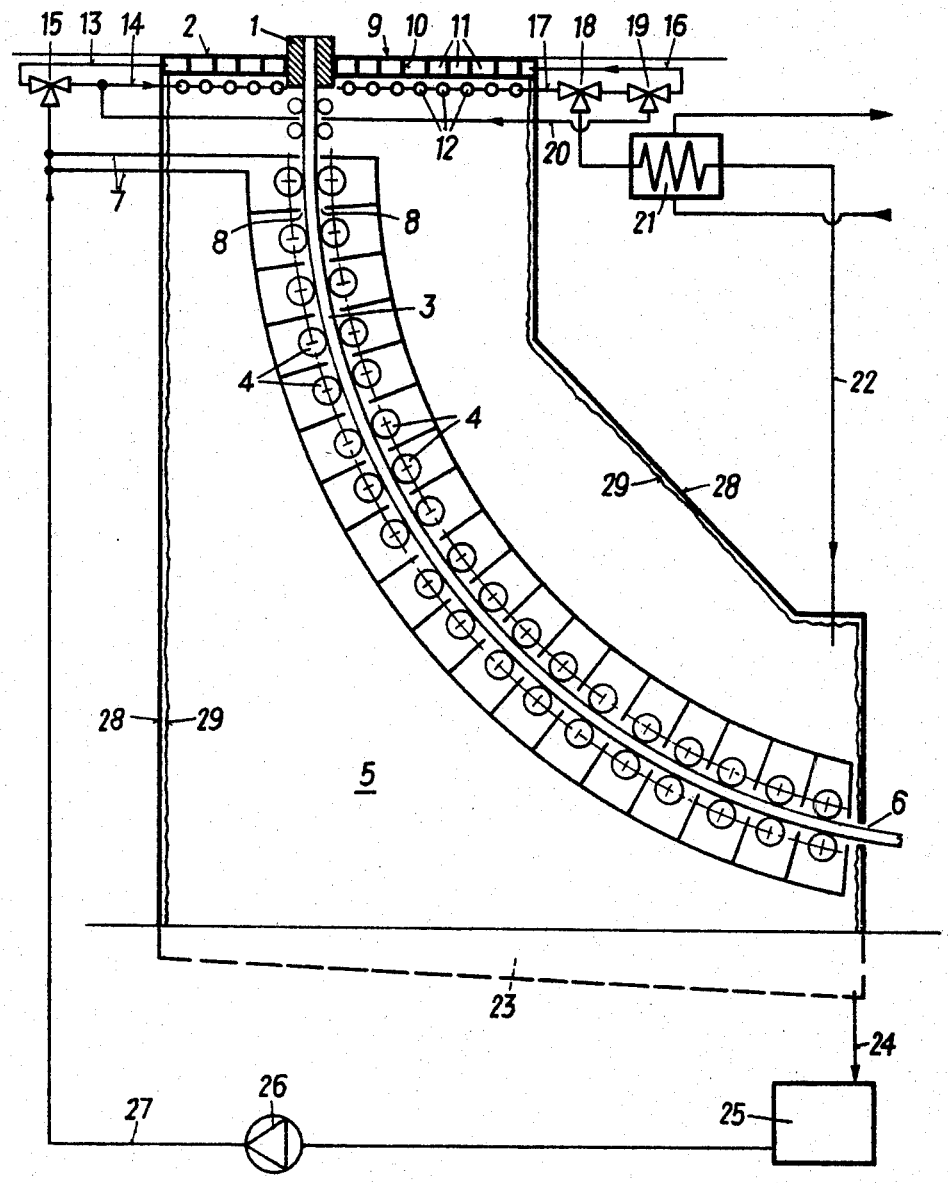
FIG. 1 is a section through a cooling chamber of a continuous casting plant for slabs.

A water-cooled mould 1 having a slab cross-section is arranged on the level of the casting platform 2. Below the mould there are strand guiding rollers 4 supporting the strand skin of the cast strand 3 and rotatably mounted in a structure (not illustrated). The steel strand 3, which is deflected into the horizontal in a quarter-circular arc, is surrounded by a cooling chamber 5 closed on all sides and leaves the cooling chamber through an opening 6, thereafter reaching a subsequently arranged horizontal strand guiding zone (not illustrated). Supply conduits 7 for a coolant (preferably treated cooling water) project into the cooling chamber, the coolant being sprayed against the surfaces of the steel strand by means of nozzles 8 arranged between the rollers 4. The ceiling 9 of the cooling chamber is designed as a closed surface condenser, that is a hollow plate provided with deflection rods 10 in its interior, thus forming meander-shaped coolant channels 11 distributedly arranged over the plate 9. Below this plate a further closed surface condenser is provided, which is a tube coil 12 laid in a meander-like manner. The coolant channels 11 and the tube coil 12 are in connection via their supply conduits 13 and, respectively, 14 and a three-way faucet 15. The discharge conduits 16 and 17, respectively, of the plate 9 and the tube coil 12 are connected with each other via two three-way faucets 18 and 19. From the three-way faucet 19, an additional conduit 20 leads to the coolant supply conduit 14 of the tube coil 12. From the three-way faucet 18 the flow-through medium, having flowed through the plate and the tube coil 12, is supplied to a heat transformer 21, which may also be designed as a boiler. Via a return conduit 22 the flow-through medium enters the cooling chamber 5. The bottom of the cooling chamber 5 comprises a scale channel 23 from whose end a conduit 24 leads the secondary cooling water to a schematically illustrated water treatment plant 25. From this water treatment plant, the secondary cooling water is supplied to the supply conduits 7 by means of a pump 26 via conduits 27.

Figure 2:
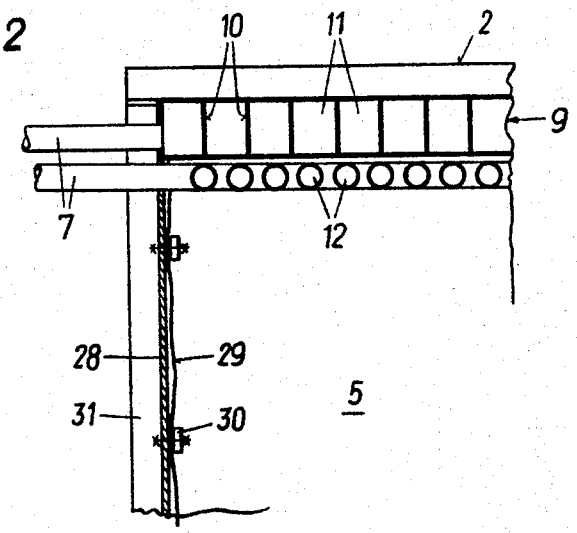
FIG. 2 is a detail of this section on an enlarged scale according to one embodiment.

The plate walls 28 of the cooling chamber 5, on their inner sides, are lined with an insulating or sealing foil 29. The foil fastening-means 30, which are schematically illustrated in FIG. 2, are mounted on the plate walls 28. The cooling chamber 5, on its outer side, is surrounded by supporting carriers 31.

Figure 3:
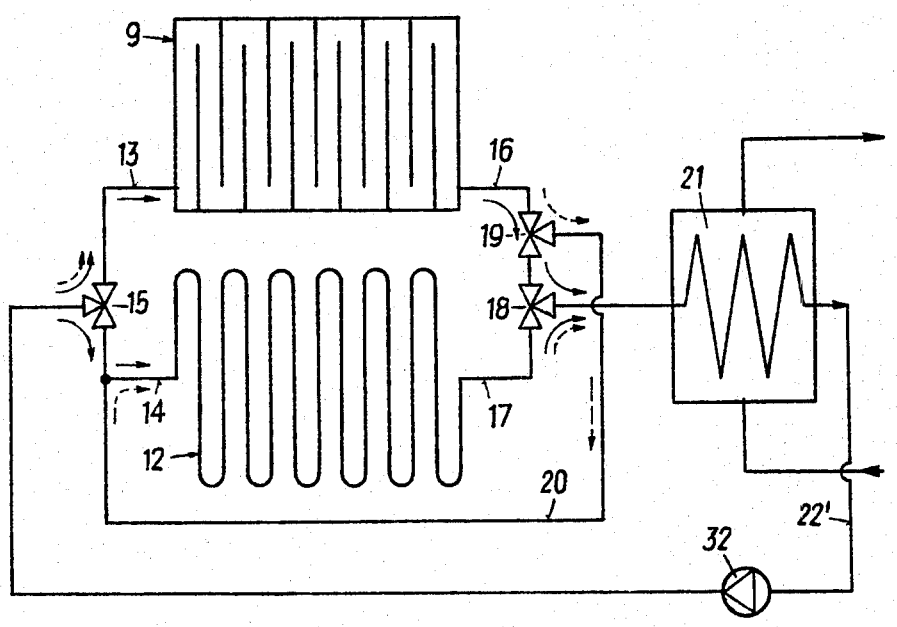
FIG. 3 illustrates the flow chart for the flow-through medium according to a second embodiment.

The arrangement functions in the following manner: The coolant provided for cooling the strand part that is within the cooling chamber 5, i.e. the coolant provided for the secondary cooling zone, is sprayed via conduits 7 and spraying nozzles 8, onto the strand surface where it evaporates partially. Part of the coolant is supplied via the supply conduits 13, 14 as a flow-through medium to the plate 9 and the tube coil 12. Depending on the position of the three-way faucets, the plate 9 and the tube coil 12 may be arranged either in parallel or in series. In FIG. 3 the parallel connection is symbolized by full arrows, the series connection is symbolized by broken arrows.

The coolant vapor forming within the cooling chamber 5 is condensed at the tube coil 12, through which the flow-through medium flows, and at the plate 9, through which the flow-through medium flows again, and drops off. If the plate and the tube coil are arranged in series, the flow-through medium can reach a temperature as high as possible, whereas with a parallel arrangement a higher amount of the flow-through medium with a lower temperature as compared to the series connection can be obtained.

The condensation heat given off to the flow-through medium is delivered to a heating medium, for instance useful water for heating buildings, etc., in the heat transformer 21 arranged outside the cooling chamber. Thereafter the flow-through medium gets back into the cooling chamber 5 via the return conduit 22; it could also be directly supplied to the water treatment plant 25.

With the embodiment illustrated in FIG. 3 the flow-through medium streaming through the plate 9 and the tube coil 12, respectively, is guided in a closed circuit independently of the coolant used for the secondary cooling. The conduit 22' leaving the heat transformer 21 therefore is connected to the three-way faucet 15 connecting the supply conduits 13, 14, with a conveying pump 32 being interposed.

In addition to the recovery of energy, the method according to the invention still has further advantages, e.g. the saving of the complex mechanics necessary for sucking off vapor, which result in a reduction of costs and energy. Nor need shafts for sucking off vapor be placed in the region of the steel construction of the hall, the hall construction thus being made simpler.

Because no vapor escapes from the continuous casting plant, the load on the environment caused by the plant is kept low. The secondary cooling water can be guided in circuit; the loss of coolant is extremely low or can be prevented altogether, so that it is possible to use a treated (decalcified) cooling water. Non-treated cooling water leads to intensive furring in the spraying nozzles as well as in the plant structures. This disadvantage thus can be eliminated. A further advantage is to be seen in the fact that the cooling chamber can be designed in a substantially simpler manner, since there is no more negative pressure within the cooling chamber and the tightness of the cooling chamber is taken over by a foil.

What I claim is:

1. A method of recovering the sensible heat of an undivided continuously cast strand guided through a cooling chamber comprising the steps of:

bringing a supply of coolant into direct contact with said strand immediately after said strand emerges from a mould into said cooling chamber and while said strand has at least a partial liquid core, thereby forming a coolant vapor, bringing the coolant vapor thus formed into heat exchange with a closed surface condenser arranged within said cooling chamber and through which a flow-through medium flows, and bringing said flow-through medium of said closed surface condenser into further heat exchange with a heat transformer arranged outside said cooling chamber.

2. A method as set forth in claim 1, wherein said flow-through medium is guided in a closed circuit independently of said coolant.

3. In an arrangement for recovering the sensible heat of a continuously cast strand, to be used in a continuous casting plant, in particular in a continuous casting plant for slabs, and of the type including a closed cooling chamber including a secondary cooling zone therein;

spraying nozzles provided in said secondary cooling zone and directed toward said cast strand; and a coolant being sprayed onto said cast strand through said spraying nozzles, the improvement wherein:

said closed cooling chamber is arranged immediately adjacent a mould so that said cast strand is guided through said cooling chamber immediately after its emergence from said mould and while said strand is undivided and has at least a partial liquid core, said arrangement further comprising at least one closed surface condenser provided within said closed cooling chamber, a flow-through medium flowing through said closed surface condenser, and at least one heat transformer arranged outside said cooling chamber and connected with said at least one closed surface condenser.

4. An arrangement as set forth in claim 3, wherein said at least one closed surface condenser is connected with said at least one heat transformer so as to form a closed circuit.

5. An arrangement as set forth in claim 3, wherein a plurality of closed surface condensers are arranged in series within said closed cooling chamber.

6. An arrangement as set forth in claim 3, wherein a plurality of closed surface condensers are parallelly arranged within said closed cooling chamber.

7. An arrangement as set forth in claim 3, wherein said closed cooling chamber has a ceiling and side walls, said at least one surface condenser being arranged on said ceiling, and wherein a foil is provided on said side walls for covering said side walls of said cooling chamber.

8. An arrangement as set forth in claim 7, wherein said foil is an insulating foil.

9. An arrangement as set forth in claim 7, wherein said foil is a sealing foil.

10. An arrangement as set forth in claim 7, wherein said foil is an insulating-sealing foil.

11. An arrangement as set forth in claim 3, wherein said at least one closed surface condenser is connected with said at least one heat transformer and the flow of said flow-through medium through said condenser is in parallel to the flow of said coolant in said secondary cooling zone.

12. A method of recovering the sensible heat of a continuously cast strand guided through a cooling chamber and brought into direct contact with a coolant partially evaporating comprises the steps of:

bringing the coolant vapor which is guided in a closed circuit into heat exchange with a closed surface condenser arranged within said cooling chamber and through which a flow-through medium flows, and bringing said flow-through medium of said closed surface condenser into further heat exchange with a heat transformer arranged outside said cooling chamber, wherein a condensate is condensed at said closed surface condenser, said condensate being used partly for newly cooling the strand surface and partly as said flow-through medium for said closed surface condenser, and wherein said flow-through medium leaving said heat transformer also is used partly for cooling the strand surface and partly as said flow-through medium for said closed surface condenser.

13. In an arrangement for recovering the sensible heat of a cast strand, to be used in a continuous casting plant, in particular in a continuous casting plant for slabs, and of the type including a closed cooling chamber, a secondary cooling zone being provided in said cloased cooling chamber for said cast strand and including spraying nozzles directed toward said cast strand, a coolant being sprayed onto said cast strand through said spraying nozzles, the improvement comprising at least one closed surface condenser provided within said closed cooling chamber and designed as a plate covering said cooling chamber and having deflection rods provided in its interior, a flow-through medium flowing through said plate, and at least one heat transformer arranged outside said cooling chamber, said plate being connected with said at least one heat transformer, and wherein a further closed surface condenser comprising a tube coil is arranged immediately below said plate.

* * * * *